US005503056A

United States Patent [19]

Evans

[11] Patent Number: 5,503,056

[45] Date of Patent: Apr. 2, 1996

[54] RESILIENTLY ARITCULATED DRUM STICK

[76] Inventor: Jeffrey T. Evans, 5 Moses Way, Box 1201, N. Truro, Mass. 02666

[21] Appl. No.: 396,482

[22] Filed: Mar. 2, 1995

[51] Int. Cl.[6] ..... G10D 13/02

[52] U.S. Cl. ..... 84/422.4; D17/22

[58] Field of Search ..... 84/422.4, 422.1, 84/422.2, 422.3; D17/22

[56] References Cited

U.S. PATENT DOCUMENTS 4,651,617 3/1987 Schwartz ..... 84/422.4

4,970,934 11/1990 Reed et al. ..... 84/422.4

*Primary Examiner*—Cassandra C. Spyrou

[57] ABSTRACT

A drum stick for rigidly and resiliently impacting a percussion instrument. The inventive device includes a handle portion and an impacting portion. A resilient coupling is interposed between the handle portion and the impacting portion to permit resilient articulation thereof relative to the handle portion. A rigid locking assembly can be selectively actuated to lock the impacting portion in a rigid and collinear orientation relative to the handle portion.

8 Claims, 4 Drawing Sheets

FIG 1
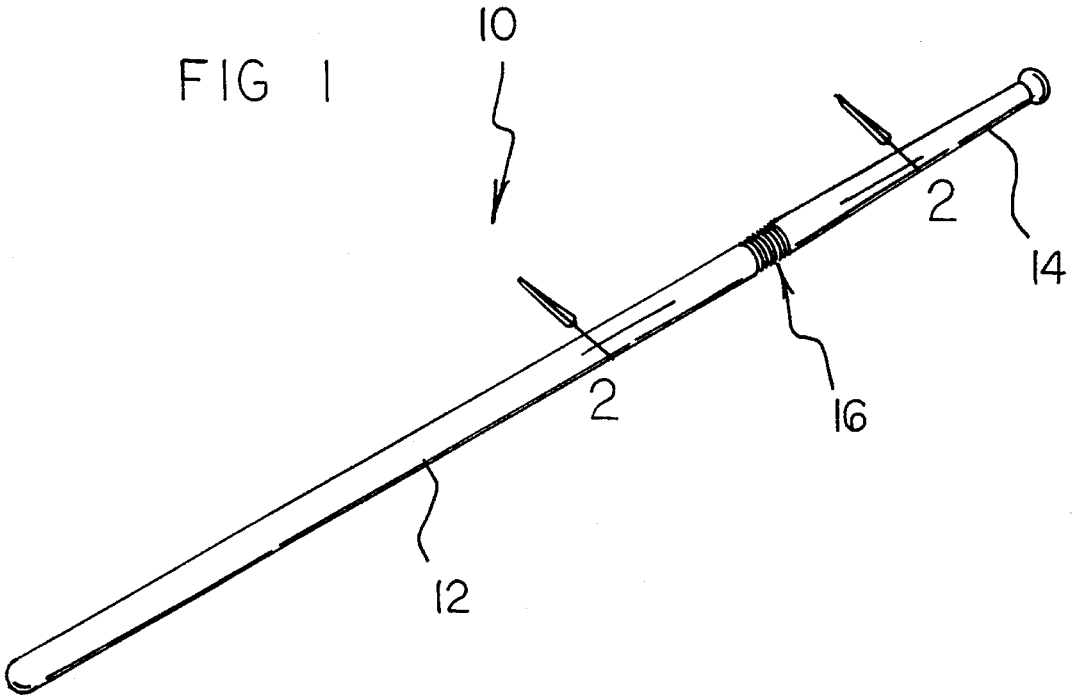
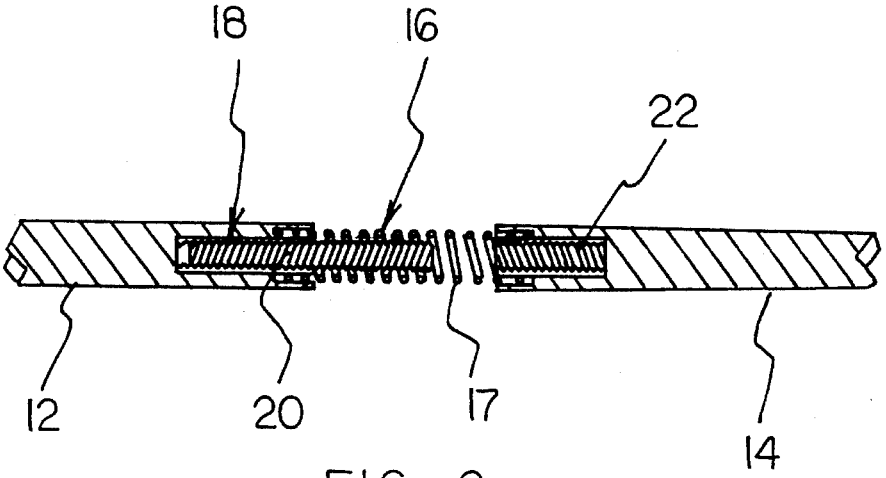
FIG 2

FIG 3
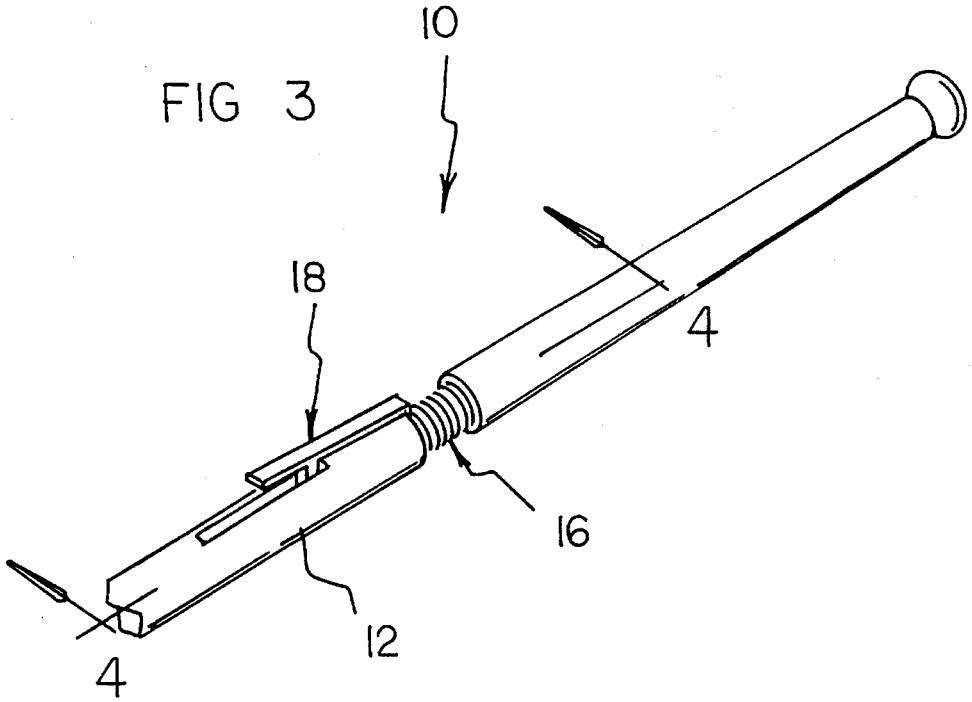
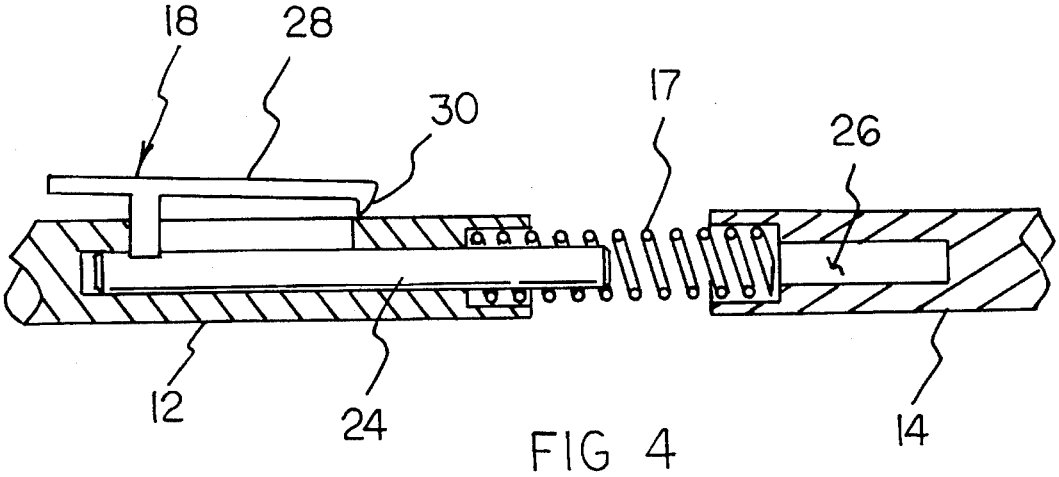
FIG 4

RESILIENTLY ARITCULATED DRUM STICK

BACKGROUND OF THE INVENTION

1. Related Data

The subject invention of this patent application has been registered under the document disclosure program. The request was received at the United States Patent and Trademark Office on Sep. 23, 1994 and was assigned the registration number 362,125.

2. Field of the Invention

The present invention relates to percussion impacting devices and more particularly pertains to a resiliently articulated drum stick for rigidly and resiliently impacting a percussion instrument.

DESCRIPTION OF THE PRIOR ART

The use of percussion impacting devices is known in the prior art. More specifically, percussion impacting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art percussion impacting devices include U.S. Pat. Nos. 4,651,617; 4,599,932; 4,127,053; 3,608,419; and U.S. Pat. No. 4,640,176.

While these devices fulfill their respective, particular objectives and requirements, the aforementioned patents do not disclose a resiliently articulated drum stick for rigidly and resiliently impacting a percussion instrument which includes a handle portion and an impacting portion with a resilient coupling interposed between the handle portion and the impacting portion to permit resilient articulation thereof relative to the handle portion, and a rigid locking assembly selectively operable by an individual to lock the impacting portion in a rigid and collinear orientation relative to the handle portion.

In these respects, the resiliently articulated drum stick according to the present invention substantially departs from the conventional concepts and designs of the prior art, and in so doing provides an apparatus primarily developed for the purpose of rigidly and resiliently impacting a percussion instrument.

SUMMARY OF THE INVENTION

In view of the foregoing disadvantages inherent in the known types of percussion impacting devices now present in the prior art, the present invention provides a new resiliently articulated drum stick construction wherein the same can be utilized for rigidly and resiliently impacting a percussion instrument. As such, the general purpose of the present invention, which will be described subsequently in greater detail, is to provide a new resiliently articulated drum stick apparatus and method which has many of the advantages of the percussion impacting devices mentioned heretofore and many novel features that result in a resiliently articulated drum stick which is not anticipated, rendered obvious, suggested, or even implied by any of the prior art percussion impacting devices, either alone or in any combination thereof.

To attain this, the present invention generally comprises a drum stick for rigidly and resiliently impacting a percussion instrument. The inventive device includes a handle portion and an impacting portion. A resilient coupling is interposed between the handle portion and the impacting portion to permit resilient articulation thereof relative to the handle portion. A rigid locking assembly can be selectively actuated to lock the impacting portion in a rigid and collinear orientation relative to the handle portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new resiliently articulated drum stick apparatus and method which has many of the advantages of the percussion impacting devices mentioned heretofore and many novel features that result in a resiliently articulated drum stick which is not anticipated, rendered obvious, suggested, or even implied by any of the prior art percussion impacting devices, either alone or in any combination thereof.

It is another object of the present invention to provide a new resiliently articulated drum stick which may be easily and efficiently manufactured and marketed.

It is a further object of the present invention to provide a new resiliently articulated drum stick which is of a durable and reliable construction.

An even further object of the present invention is to provide a new resiliently articulated drum stick which is susceptible of a low cost of manufacture with regard to both materials and labor, and which accordingly is then susceptible of low prices of sale to the consuming public, thereby making such resiliently articulated drum sticks economically available to the buying public.

Still yet another object of the present invention is to provide a new resiliently articulated drum stick which provides in the apparatuses and methods of the prior art some of the advantages thereof, while simultaneously overcoming some of the disadvantages normally associated therewith.

Still another object of the present invention is to provide a new resiliently articulated drum stick for rigidly and resiliently impacting a percussion instrument.

Yet another object of the present invention is to provide a new resiliently articulated drum stick which includes a handle portion and an impacting portion with a resilient coupling interposed between the handle portion and the impacting portion to permit resilient articulation thereof relative to the handle portion, and a rigid locking assembly selectively operable by an individual to lock the impacting portion in a rigid and collinear orientation relative to the handle portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a resiliently articulated drum stick according to the present invention.

FIG. 2 is a cross sectional view taken along line 2—2 of FIG. 1.

FIG. 3 is an enlarged isometric illustration of a portion of the present invention including an alternative form of a rigid locking means.

FIG. 4 is a cross sectional view taken along line 4—4 of FIG. 3.

DESCRIPTION OF THE PREFERRED EMBODIMENT

Figure 5:
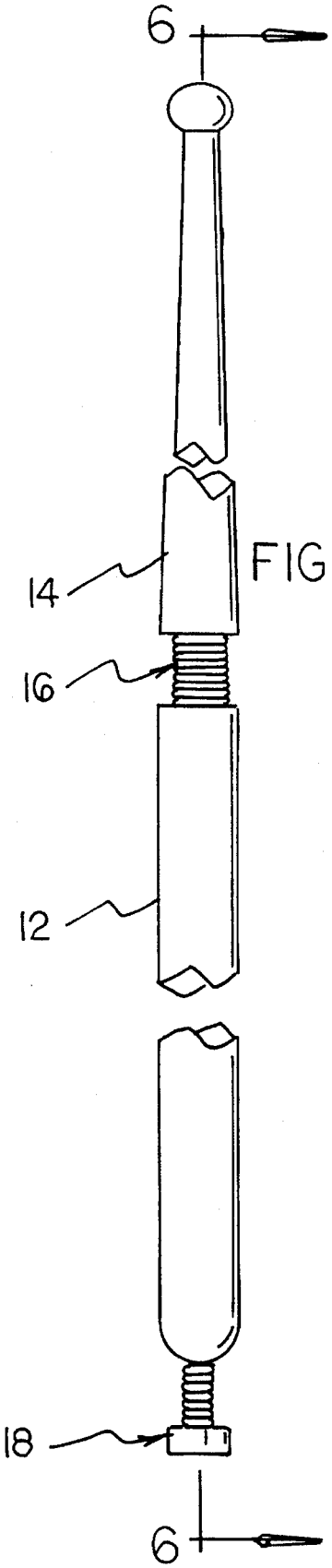
FIG. 5 is an elevation view of the invention including a further alternative form of the rigid locking means.

With reference now to the drawings, and in particular to FIGS. 1–8 thereof, a new resiliently articulated drum stick embodying the principles and concepts of the present invention and generally designated by the reference numeral 10 will be described.

More specifically, it will be noted that the resiliently articulated drum stick 10 comprises a handle portion 12 of elongated and substantially cylindrical configuration suitable for being grasped and manipulated by an individual during playing or impacting of a percussion instrument. An impacting portion 14 is coupled to the handle portion 12 and operates for striking or impacting a percussion instrument during play thereof. A resilient coupling means 16 is interposed between the handle portion 12 and the impacting portion 14 to permit resilient articulation of the impacting portion 14 relative to the handle portion 12. Preferably, the resilient coupling means 16 maintains the impacting portion 14 in a substantially collinear orientation relative to the handle portion 12 during periods of non-use thereof. By this structure, the resilient coupling means 16 permits the impacting portion 14 to articulate relative to the handle portion 12 to accomplish heretofore unknown methods of impacting a percussion instrument.

As shown in FIG. 2, the resilient coupling means 16 according to the present invention 10 preferably comprises a coil spring 17 projecting from an end of the handle portion 12 and coupling with an end of the impacting portion 14. The coil spring 17 is preferably rotatably coupled to either or both of the portions 12 and 14. Such rotatably coupling of the spring 17 to either of the portions 12 or 14 can be accomplished through annular flanges projecting radially inward and engaging individual helical coils of the spring 17. Such annular flanges are not illustrated in the drawings for clarity. By this structure, the coil spring 17 permits resilient articulation of the impacting portion 14 relative to the handle portion 12 during use of the drumstick 10 in impacting a percussion instrument.

With continuing reference to FIG. 2, it can be shown that the present invention 10 may further comprise a rigid locking means 18 for selectively locking the impacting portion 14 in a rigid and collinear orientation relative to the handle portion 12. To this end, the rigid locking means 18 may comprise a threaded shaft 20 projecting from an end of the handle portion 12 and through a center of the coil spring 17. A threaded receiver 22 mounted within an end of the impacting portion 14 can be threadably engaged to the threaded shaft 20 to create a rigid coupling between the impacting portion 14 and the handle portion 12.

Referring now to FIGS. 3 and 4 of the drawings, it can be shown that the rigid locking means 18 according to the present invention 10 may alternatively comprise a locking rod 24 slidably positioned within a cylindrical bore directed into an end of the handle portion 12. The locking rod 24 can be selectively positioned through the coil spring 17 and into a receiving bore 26 directed into an end of the impacting portion 14. To facilitate manual sliding of the locking rod 24 into the receiving bore 26 of the impacting portion 14, a resilient catch 28 projects exteriorly of the handle portion 12 through an elongated slot and includes a depending projection 30 positionable over the end of the handle portion 12 so as to retain the locking rod 24 within the receiving bore 26 as desired.

Figure 6:
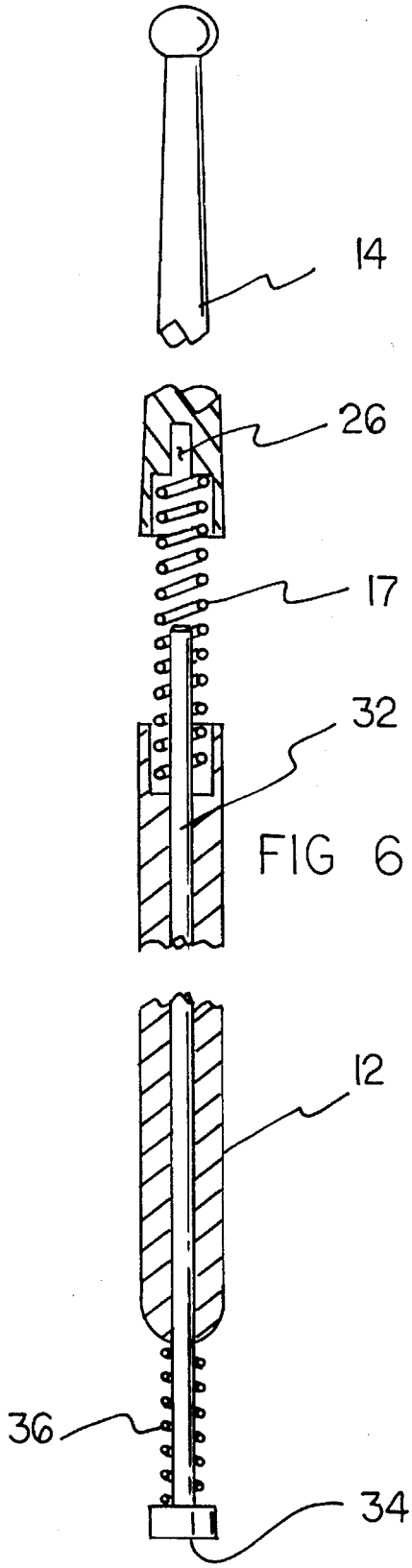
FIG. 6 is a cross sectional view taken along line 6—6 of FIG. 5.
Figure 7:
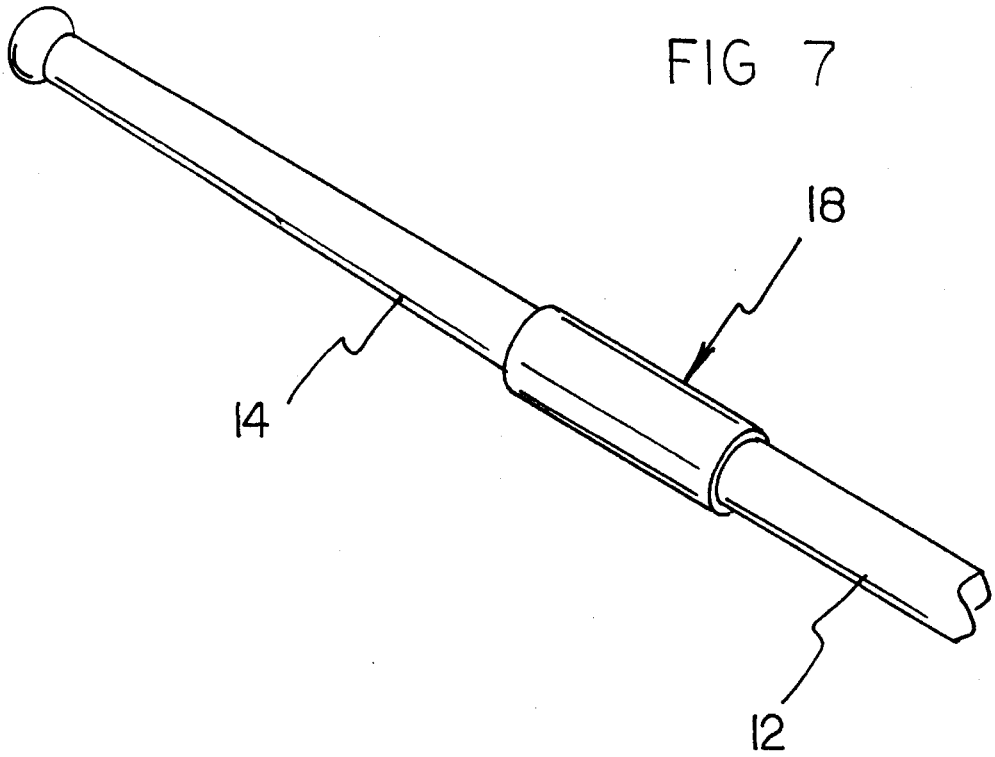
FIG. 7 is an enlarged isometric illustration of a portion of the invention including another alternative form of the rigid locking means.
Figure 8:
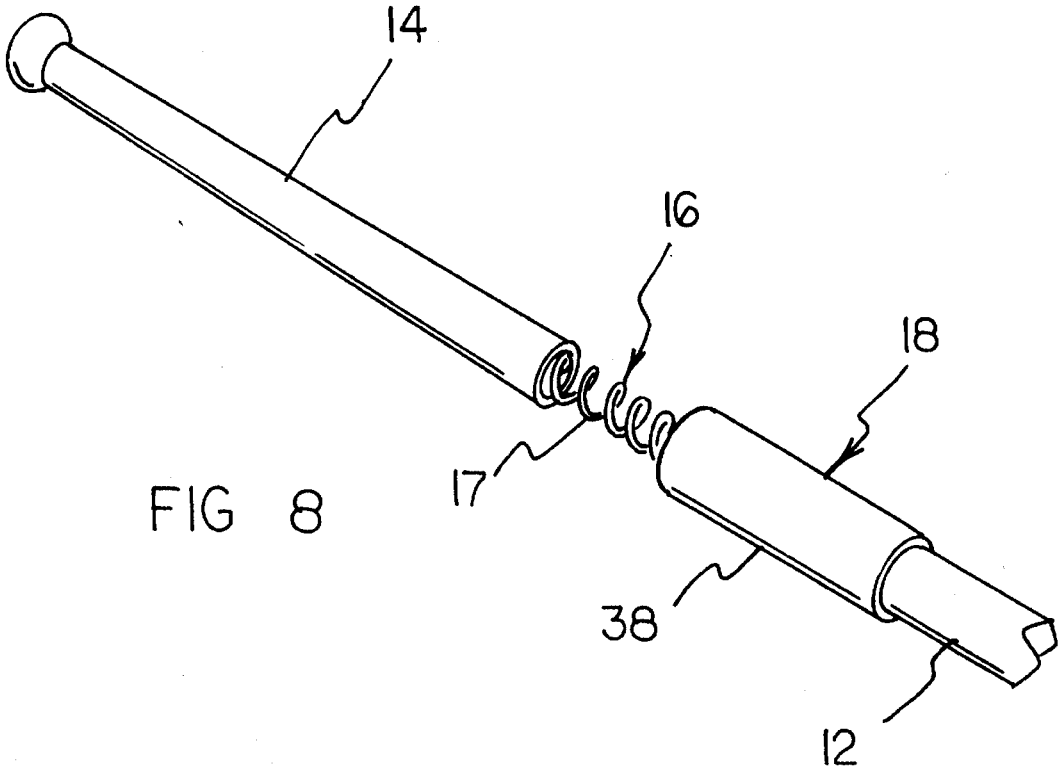
FIG. 8 is an isomeric illustration of the invention as illustrated in FIG. 7 in an unlocked configuration.

As shown in FIGS. 5 and 6, the rigid locking means 18 according to the present invention 10 may further alternatively comprise an elongated push rod 32 projecting through a cylindrical bore extending longitudinally through the handle portion 12. The push rod 32 terminates exteriorly of a first end of the handle portion 12 in an end cap 34. A return spring 36 is interposed between the end cap 34 and the first end of the handle portion 12 to maintain the push rod 32 in a retracted position relative to a second end of the handle portion 12 beyond which the push rod 32 extends into a center of the coil spring 17. The end cap 34 can thus be biased against a force of the return spring 36 towards the first end of the handle portion 12 to project the push rod 32 into a receiving bore 26 formed in the impacting portion 14 to lock the impacting portion 14 in a substantially rigid and collinear orientation relative to the handle portion Referring now to FIGS. 7 and 8, it can be shown that the rigid locking means 18 according to the present invention 10 may yet further alternatively comprise an exterior collar 38 slidably positioned over the handle portion 12 which can be axially biased by an individual concentrically over a portion of the impacting portion 14 to lock the impacting portion 14 relative to the handle portion 12.

In use, the resiliently articulated drumstick 10 according to the present invention can be easily utilized to rigidly or resiliently impact a percussion instrument. The various forms of the rigid locking means 18 permit the impacting portion 14 to be selectively locked into a rigid and collinear orientation relative to the handle portion 12 as desired by an end user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A resiliently articulated drum stick comprising:

a handle portion means for being grasped and manipulated by an individual;

an impacting portion means for striking a percussion instrument;

a resilient coupling means interposed between the handle portion means and the impacting portion means for permitting resilient articulation of the impacting portion relative to the handle portion;

wherein the resilient coupling means normally maintains the impacting portion means in a substantially collinear orientation relative to the handle portion means during periods of non-use thereof;

wherein the resilient coupling means comprises a coil spring projecting from an end of the handle portion means and coupling with an end of the impacting portion means.

2. The resiliently articulated drum stick of claim 1, and further comprising a rigid locking means for selectively locking the impacting portion means in a rigid and collinear orientation relative to the handle portion means.

3. The resiliently articulated drum stick of claim 2, wherein the rigid locking means comprises a threaded shaft projecting from the end of the handle portion means and through a center of the coil spring; and a threaded receiver mounted within the end of the impacting portion means which can be threadably engaged to the threaded shaft to create a rigid coupling between the impacting portion means and the handle portion means.

4. The resiliently articulated drum stick of claim 2, wherein the rigid locking means comprises a locking rod slidably positioned within a cylindrical bore directed into the end of the handle portion means, the locking rod being selectively positionable through the coil spring and into a receiving bore directed into the end of the impacting portion means.

5. The resiliently articulated drum stick of claim 4, wherein the rigid locking means further comprises a resilient catch projecting exteriorly of the handle portion means which includes a depending projection positionable over the end of the handle portion means so as to retain the locking rod within the receiving bore.

6. The resiliently articulated drum stick of claim 2, wherein the rigid locking means comprises an elongated push rod projecting through a cylindrical bore extending completely longitudinally through the handle portion means, the push rod terminating exteriorly of a first end of the handle portion means in an end cap; and a return spring interposed between the end cap and the first end of the handle portion means to maintain the push rod in a retracted position relative to a second end of the handle portion means beyond which the push rod extends into a center of the coil spring, wherein the end cap can be manually biased against a force of the return spring towards the first end of the handle portion means to project the push rod into a receiving bore formed in the end of the impacting portion means to lock the impacting portion means in a substantially rigid and collinear orientation relative to the handle portion means.

7. The resiliently articulated drum stick of claim 2, wherein the rigid locking means comprises an exterior collar slidably positioned over the handle portion means which can be axially biased concentrically over a portion of the impacting portion means to lock the impacting portion means relative to the handle portion means.

8. A resiliently articulated drum stick comprising:

a handle portion means for being grasped and manipulated by an individual;

an impacting portion means for striking a percussion instrument;

a resilient coupling means interposed between the handle portion means and the impacting portion means for permitting resilient articulation of the impacting portion relative to the handle portion;

wherein the resilient coupling means normally maintains the impacting portion means in a collinear orientation relative to the handle portion means such that a longitudinal axis of the impacting portion means extends along a longitudinal axis of the handle portion means.

* * * * *